US006434250B1

(12) United States Patent
Tsuhako

(10) Patent No.: US 6,434,250 B1
(45) Date of Patent: Aug. 13, 2002

(54) STEREO HEADSET WITH ANGLED SPEAKERS

(76) Inventor: Parker I. Tsuhako, 17016 Alexander Ave., Cerritos, CA (US) 90703

( * ) Notice: Subject to any disclaimer, the term of this patent is extended or adjusted under 35 U.S.C. 154(b) by 0 days.

(21) Appl. No.: 09/517,991

(22) Filed: Mar. 3, 2000

Related U.S. Application Data

(60) Provisional application No. 60/122,919, filed on Mar. 5, 1999.

(51) Int. Cl.[7] ..... H04R 25/00

(52) U.S. Cl. ..... 381/374; 381/370; 381/378; 381/379

(58) Field of Search ..... 381/328, 327, 381/329, 330, 370, 371, 373, 374, 376, 377, 378, 379, 380, 381; 379/430

(56) References Cited

U.S. PATENT DOCUMENTS

| | | | | | |
|---|---|---|---|---|---|
| 1,133,833 | A | * | 3/1915 | Randall | 381/374 |
| 2,235,372 | A | * | 3/1941 | Kalbitz | 381/379 |
| 3,900,707 | A | | 8/1975 | Hanson | |
| 3,919,501 | A | | 11/1975 | Cech et al. | |
| 4,027,113 | A | | 5/1977 | Matsumoto et al. | |
| 4,689,822 | A | | 8/1987 | Houng | |
| 5,333,206 | A | | 7/1994 | Koss | |
| 5,335,285 | A | * | 8/1994 | Gluz | 381/327 |
| 5,519,782 | A | | 5/1996 | Shinohara et al. | |
| 5,708,724 | A | * | 1/1998 | Burris et al. | 381/370 |
| 5,790,683 | A | * | 8/1998 | Salzani | 381/379 |

* cited by examiner

*Primary Examiner*—Huyen Le
*Assistant Examiner*—Suhan Ni
(74) *Attorney, Agent, or Firm*—Bissell & Bissell; Henry M. Bissell, III; Henry M. Bissell, IV

(57) ABSTRACT

Stereo apparatus having angled speakers so as to direct sound at a desired angle relative to the ears of the listener. The disclosed arrangements enhance the stereo sound effect and provide accurate stereo imaging, as well as sound stage expansion, through the proper placement and orientation of speaker units relative to the ears of a listener. The speaker units may be positioned at optimum angles of incidence and distances relative to the ears of a listener. Adjustable positioning means are provided to enable control over the horizontal spatial dimension of the stereo sound. The speaker units may be fixed at a preset orientation, or pivotally mounted for positional adjustment by the listener. Speaker units and releasable mounts may be provided for attachment to eyeglass-style temple pieces for added convenience and comfort. A number of mounting arrangements for simplifying selection of the desired earphone angle are disclosed.

5 Claims, 7 Drawing Sheets

STEREO HEADSET WITH ANGLED SPEAKERS

CROSS-REFERENCE TO RELATED APPLICATION

This application claims the benefit of U.S. Provisional Application No.: 60/122,919, filed Mar. 5, 1999.

BACKGROUND OF THE INVENTION

1. Field of the Invention

This invention relates generally to headsets for sound reproduction, specifically headsets for accurately reproducing stereo sound and imaging, and, more particularly, to improvements in such stereo headsets, including expansion of the sound stage, and to solutions to some of the problems raised or not resolved thereby.

2. Description of the Related Art

Manufacturers of headsets have traditionally positioned the speaker elements either covering the ear, on the ear, or in the ear canal of the listener. These conventional placement methods create certain undesirable listening characteristics. Conventional headsets are often cited as being deficient in reproducing accurate stereo imaging and having limited sound stage. (The term "sound stage", as used in audio or video sound recordings, generally refers to the left-right spread of the sound between the speakers in a playback system. Thus the greater or more expanded the sound stage, the closer the resemblance to the real performance in the case of an orchestra or band recording playback, for example.) The stereo image produced by conventional headsets is often criticized for having poor spatial dimension, lacking "sound stage" realism, and producing "sound in the middle of the head" imaging. Prolonged listening with conventional stereo headsets may produce feelings of pressure or even a sensation of heaviness in the ears.

The inferior sound performance and discomfort which accompany conventional headset designs stem from the fact that such designs prevent either ear from receiving signals from the stereo channel directed to the other ear. Therefore, each ear hears only one stereo channel. This arrangement eliminates the subtle clues employed by the brain in determining the location of each sound's point of origin, which are critical and essential to the accurate perception of stereo sound and imaging.

A headphone of the in-the-ear type has been proposed, in which a housing containing a speaker unit is inserted into the cavum concha of the listener's ear. As is described in U.S. Pat. No. 5,519,782, issued to Shinohara et al., this type of headphone provides an arrangement whereby the speaker/acoustic transducer is partially inserted into the ear.

A headphone combining the vertical in-the-ear type headset and the conventional flat-against-the-ear type headset has been proposed, in which the in-the-ear first acoustic transducer is mounted at right angles to the flat-against-the-ear second acoustic transducer. As is described in U.S. Pat. No. 5,333,206, issued to Koss, this type of headset is worn such that when the second transducer is flat against the ear in a conventional manner, the in-the-ear first transducer extends into the cavum concha in the listener's ear.

A conventional headset incorporating rotatable couplings between the earphone portions and the headband has been proposed, such that the earphone portions of the headset can rotate about the axis of the headband and thereby permit the headset to adapt to differently angled ears and also fold flat for more convenient transportation. As in the case of a headset with a single earphone, such an arrangement enables the earphone to be mounted adjacent either ear. As is described in U.S. Pat. No. 4,689,822, issued to Houng, this type of headset fails to address the deficiencies commonly encountered with conventional headset designs.

U.S. Pat. No. 3,900,707, issued to Hanson, provides a complex arrangement of mounted multiple speakers for enabling the reproduction of quadraphonic sound. A rather large and elaborate headgear is described having particularly-shaped cavities and particularly positioned speakers to introduce certain phase relationships in the sound that is reproduced. The overall size and complexity of the device described precludes its convenient and practical use and interferes with the activities and field of vision of the listener. In a word, this is a kluge. It does not address the problems solved by the present invention.

U.S. Pat. No. 4,027,113, issued to Matsumoto, et al. provides a coupling means for mounting the earcup to the headband portion of a conventional headset. The disclosed coupling means comprises a partial ball-and-socket mount to provide universal pivoting such that the earcup may fit and adapt to any type of ear. The listening effects provided by such design present all of the stereo imaging deficiencies encountered with conventional headset design.

A headset arrangement for holding the earphones flat against the ears is provided for in U.S. Pat. No. 3,919,501, issued to Cech et al. The against-the-ear arrangement provided therein fails to address the listening deficiencies commonly encountered with conventional headset design.

This invention relates to improvements to the stereo headset apparatus set forth above and to solutions to some of the problems raised or not resolved thereby.

SUMMARY OF THE INVENTION

The present invention comprises a stereo headset for use by a listener. Various arrangements in accordance with the invention enhance the quality of stereo sound and enable accurate stereo imaging through the proper placement and orientation of speakers relative to the ears of a listener. Accurate presentation of stereo sound and imaging, as well as expanded sound stage, is achieved through the proper positioning and orienting of the speakers rather than by means of audio propagation techniques or signal manipulation methods.

Particular arrangements of the present invention are effective in reproducing high-quality stereo sound and imaging and expanded sound stage through the application of principles of physics relating to sound and its properties. These arrangements project stereo sound waves from the speaker units to the ears of a listener under conditions of optimum angularity, embodying the ideal distance from the ear, and under controlled conditions in order to achieve stereo sound of superior quality with heightened image realism.

In accordance with the present invention, a speaker assembly is oriented at an angle to and spaced from the auditory canal rather than being generally in line therewith when the assembly is in place on the ear of the listener, as is commonly found in conventional headset designs. Through the configuration of the present invention, the speaker units may be positioned at optimum angles of incidence relative to the auditory canals of a listener such that the sound waves will diffract into the auditory canal. Furthermore, by providing adequate distance between the speaker assemblies and the listener's ears, the present invention greatly heightens the stereo sound and imaging accuracy, thereby reducing the troubling stereo imaging phenomenon commonly encountered with conventional headset designs.

By increasing or decreasing the angle of the speaker units relative to the listener's ear, the horizontal spatial dimension of the stereo sound may be narrowed or spread. This feature is not provided by any of the references cited herein.

The angle of projection of the speaker units of the present invention may be preset at a fixed angle generally suitable for most listeners, or each speaker unit may be adjustably mounted. Such adjustable mounting of the speaker units provides means by which angular adjustments may be performed by the listener to yield the most desirable stereo effect. For those who prefer the conventional flat-against-the-ear mode, such an orientation is provided by disclosed embodiments of the invention.

Angular adjustment means may comprise cross-axis pivoting joints, spline and shaft assemblies, ball and socket joints, and other variable positioning means. Such adjustable angular positioning means may be fixed or secured once the speaker units have been adjusted to the angle desired by the listener. Such angular adjusting means and securing means are well known in the art but, as used in connection with the disclosed embodiments of the present invention, constitute equivalent arrangements for the practice of the invention.

In marked contrast to conventional stereo headset design, the present invention positions the speaker units adjacent to the auricle of the listener's ear without covering or obscuring the ear, such that the ear is located in the near field of the speaker units where sound clarity and imaging are most pronounced. Through this design, the stereo headset of the present invention avoids covering the auricle in order to prevent the head-in-a-barrel sensation, all the while permitting the free exchange of sound waves between the speaker units and both of the listener's auditory canals. The speaker configuration and positioning of the present invention provide a more natural acoustical setting for the unrestricted dispersion of sound waves in marked contrast to conventional headset designs.

BRIEF DESCRIPTION OF THE DRAWINGS

A better understanding of the present invention may be realized from a consideration of the following detailed description, taken in conjunction with the accompanying drawings, in which.

DESCRIPTION OF THE PREFERRED EMBODIMENTS

Embodiments of the present invention will hereinafter be described with reference to the drawings.

Figure 1:
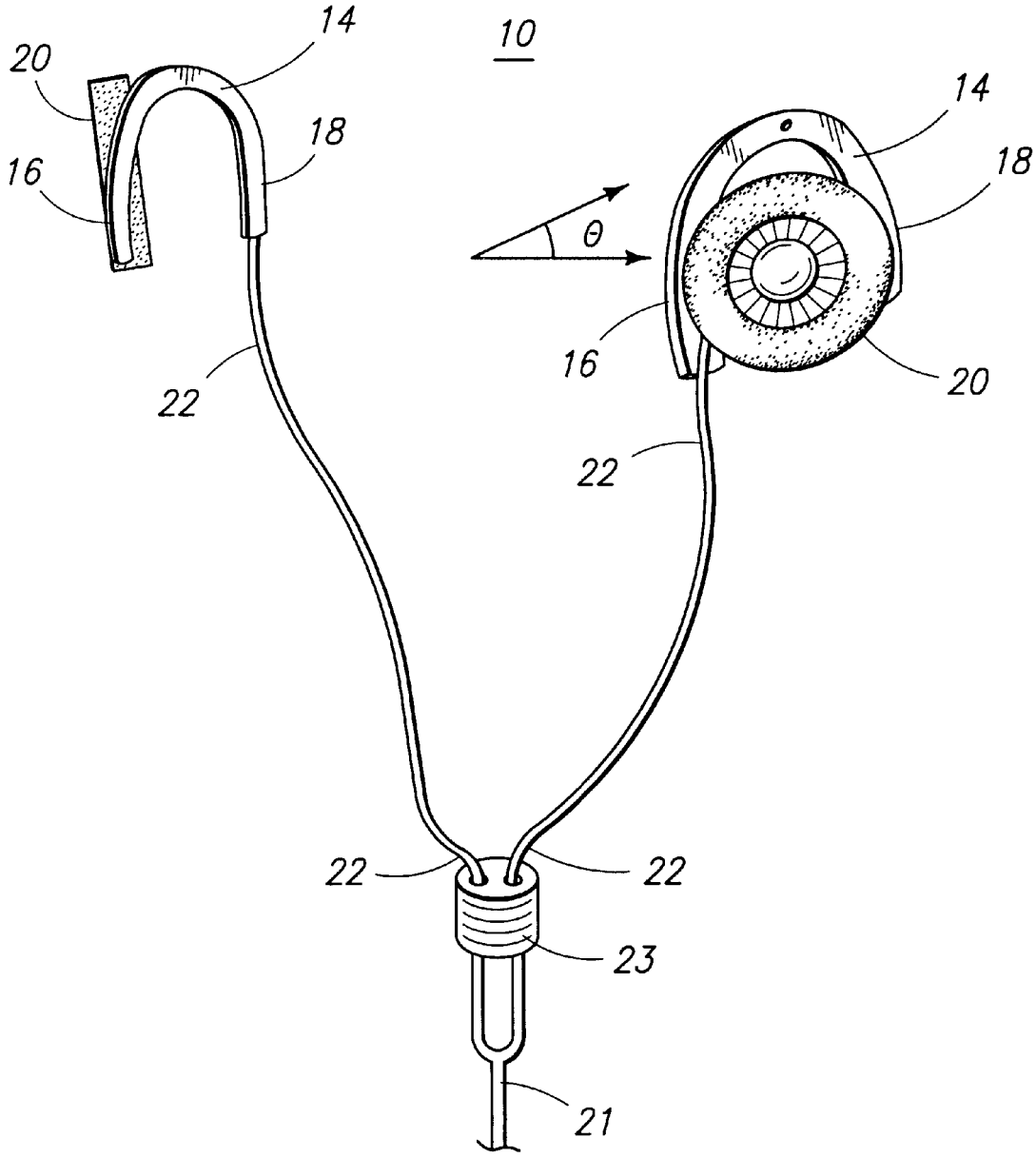
FIG. 1 is a perspective view showing a pair of earphones according to a first embodiment of the present invention.

FIG. 1 of the accompanying drawings shows a pair of interconnected earphones 20 according to a first embodiment 10 of the present invention. Generally "U"-shaped members 14 comprise anterior arms 16 and posterior arms 18 designed to fit over the ears on the head of a listener, between the pinna and the head on each side.

Speaker units 20 are attached to anterior arms 16 at an angle Θ relative to the plane of the ears of a listener, which plane parallels an imagined vertical plane bisecting the head of a listener into symmetrical halves. Speaker cords 21, 22 connect speaker units 20 to an audio signal source (not shown). Element 23 is a slidable friction keeper to hold the cords 22 under slight tension to keep the speaker units from moving out of position.

Figure 2:
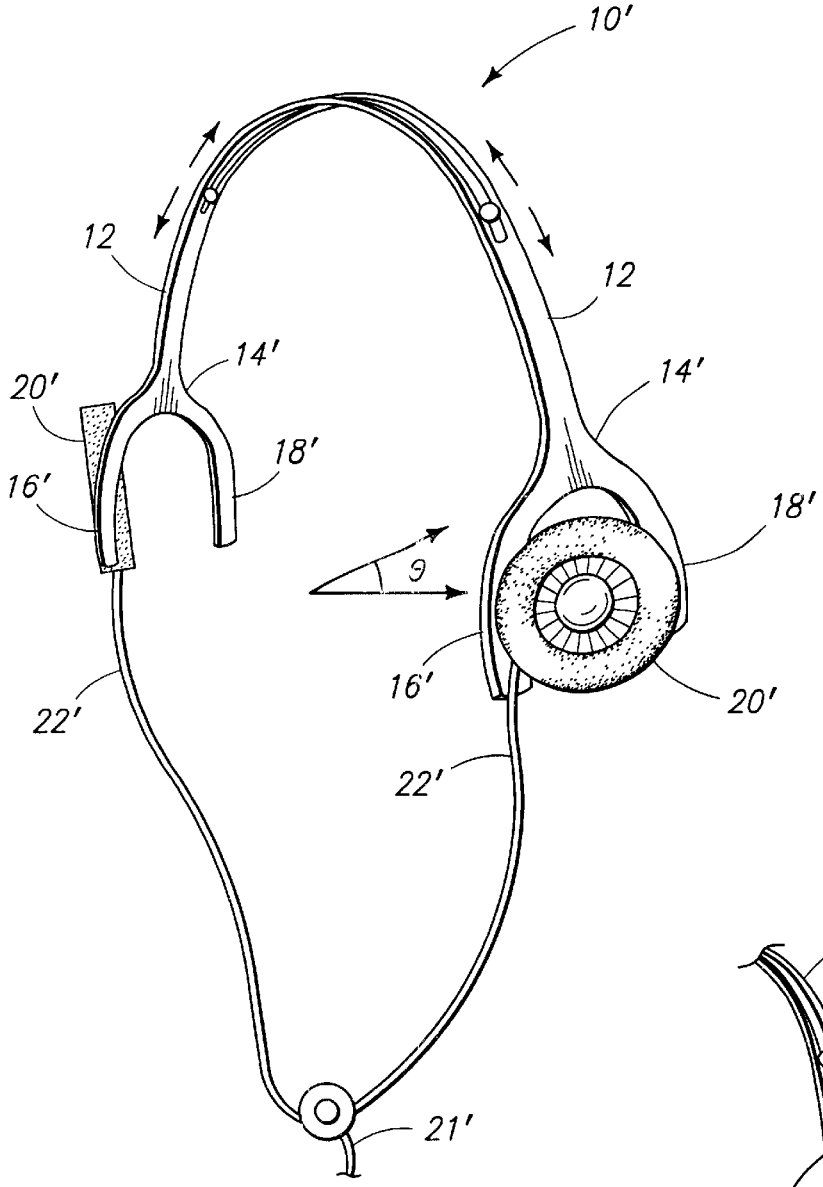
FIG. 2 is a perspective view of a headset comprising a variant of the earphones of FIG. 1 in which like elements are designated by like reference numerals with the prime designation added.

FIG. 2 of the accompanying drawings shows a headset according to a variant 10' of the embodiment of FIG. 1. Apparatus 10' includes a headband portion 12, slidably adjustable to generally fit over the head of a listener. The headband portion 12 connects to a pair of generally "U"-shaped members 14' which comprise anterior arms 16' and posterior arms 18' designed to fit over the ears on the head of a listener, between the pinna and the head on each side. Speaker units 20' are attached to anterior arms 16' at an angle Θ relative to the plane of the ears of a listener, which plane parallels an imagined vertical plane bisecting the head of a listener into symmetrical halves. Speaker cords 21', 22' connect speaker units 20' to an audio signal source (not shown).

Figure 2A:
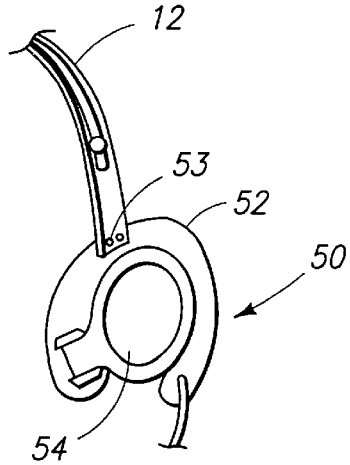
FIG. 2A is a schematic diagram illustrating an alternative version of a portion of the arrangement of FIG. 2.
Figure 4A:
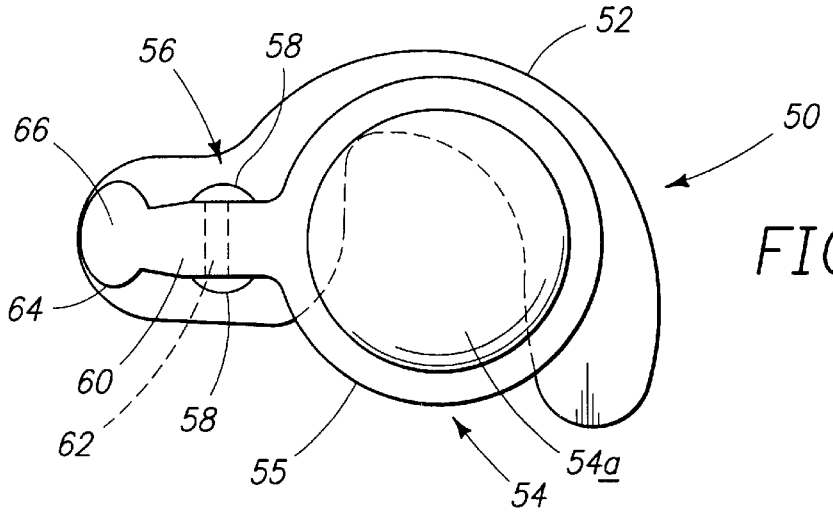
FIGS. 4A and 4B are, respectively, side elevational and top views of a left-side mounting arrangement for an earphone of the present invention.

As shown in FIG. 2A, which depicts a positioning member 52 of an earphone assembly 50 such as is shown in FIG. 4A, the member 52 may be attached to adjustable headband 12 by fastening members 53. Members 53 may be screws or rivets or any comparable fasteners.

Figure 3:
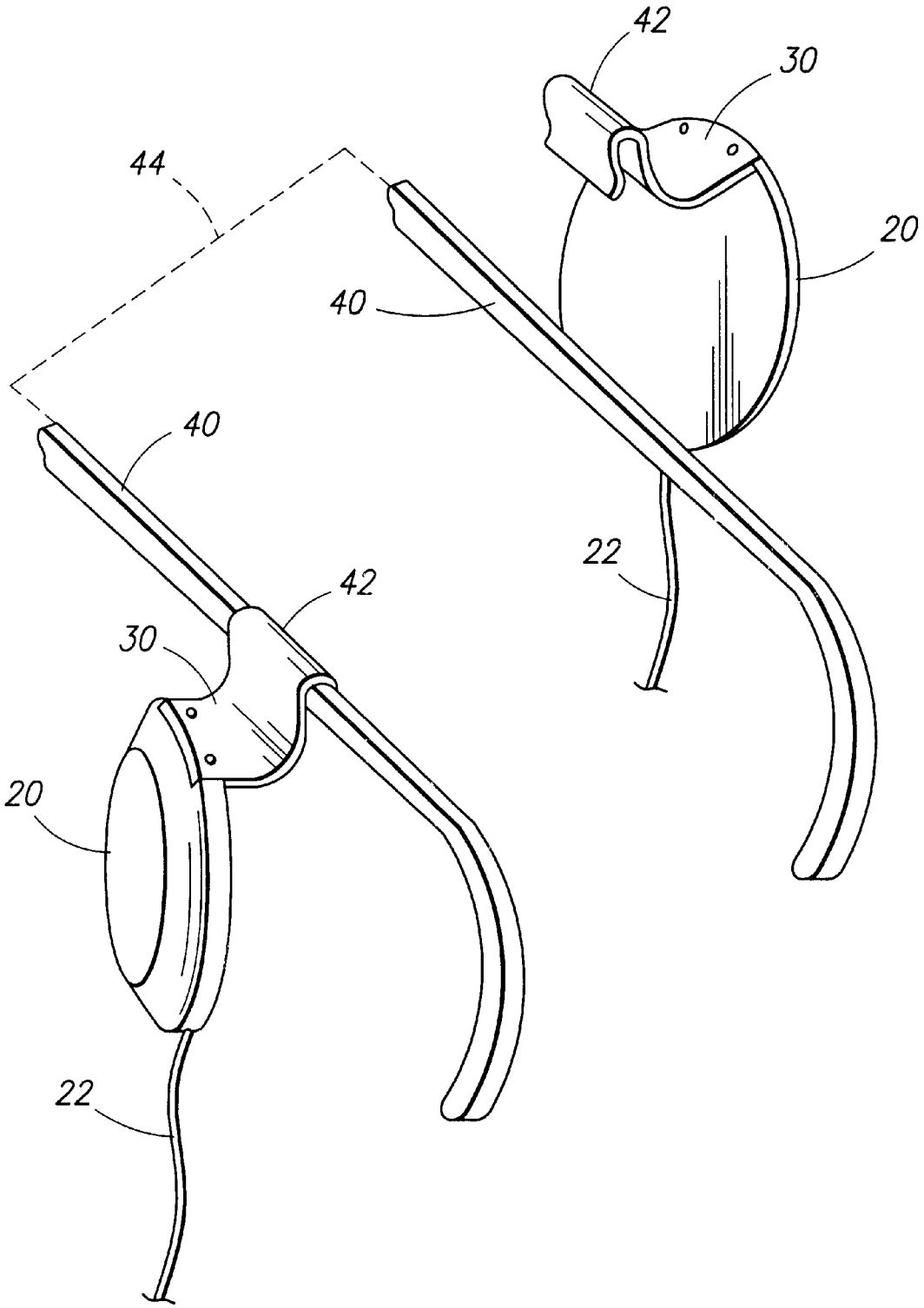
FIG. 3 is a partial perspective view showing a headset according to a second embodiment of the present invention.

FIG. 3 depicts a headset apparatus constructed according to a second preferred embodiment of the present invention. Speaker units 20 are secured to hangers 30 having spring clip mounts 42 for releasable attachment to eyeglass temple pieces 40 of a pair of eyeglasses to be worn by a listener. The remaining portion of the eyeglasses is signified by the broken line 44 extending between the terminations of the temple pieces 40. The invention provides for the positioning of speaker units 20 at a distance from the ears of a listener, and at an angle Θ relative to an imagined vertical plane bisecting the head of a listener into symmetrical halves.

Figure 4B:
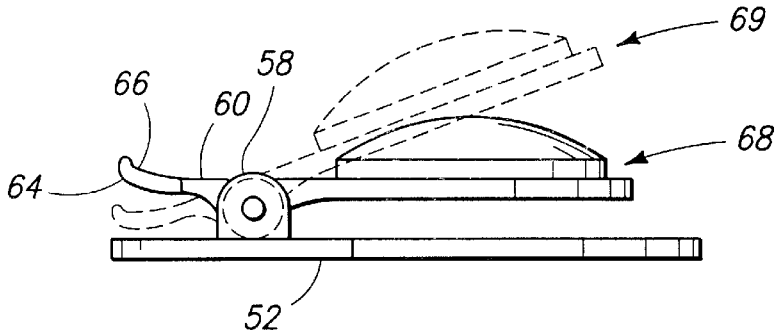

FIGS. 4A and 4B, respectively a left-side view and top view, depict an adjustable earphone mounting arrangement for a user's left ear. When the adjustable earphone mounting arrangement of FIGS. 4A and 4B is considered as an arrangement to be worn at the left ear, the pivot arrangement would be positioned slightly forward of the ear and the earphone 54 would be angled outwardly and slightly forward of the external auditory canal, or meatus, of the wearer's ear. However, the arrangement of FIGS. 4A and 4B could as well be worn on the right ear, in which case the pivoting arrangement would be at the back of the ear and the earphone 54, when angled outwardly, would be slightly behind the external auditory canal, or meatus, of the ear. The path of the sound from the angled earphone 54 would still be directed at the opening of the auditory canal. In each case, a mirror image unit may be provided for the other ear in order to develop the desired stereophonic effect.

In these figures, the assembly 50 is shown comprising a mounting piece 52 shaped to fit over the left ear of the user, and an earphone 54 incorporating a speaker 54*a* in a frame 55 coupled to the earpiece 52 by a pivoted mounting arrangement 56. The mounting 56 comprises a pair of outwardly directed ears 58 on opposite sides of an extended portion 60 of the earphone frame 55. A pivot pin 62 extends between the members 58 and through the portion 60. A further extension of the earphone frame 55 provides a lever member 64 elliptically shaped to provide a finger tab 66 for ready manipulation of the earphone and frame between conventional flat-against-the-ear position 68, indicated by the solid outline earphone structure in FIG. 4B, and angled operating position 59, indicated by the broken outline 69 in FIG. 4B.

Figure 5A:
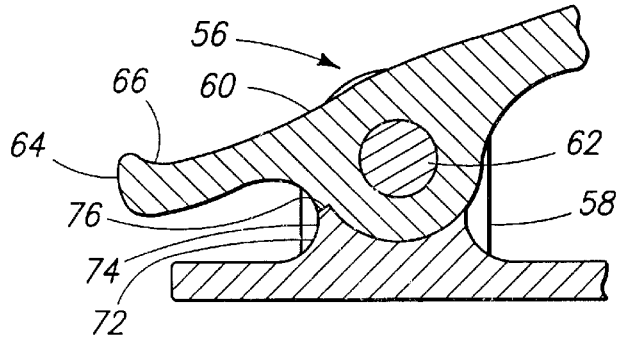
FIGS. 5A and 5B are schematic sectional views showing further details of the pivoted mounting arrangements of FIGS. 4A and 4B.

FIG. 5A is a cross-sectional view showing one version of the pivot arrangement 56 of FIG. 4A having friction cam surfaces to hold the selected angular position of the earphone. In the arrangement of FIG. 5A, the mounting piece 52 is provided with an outwardly extending portion 72 in the area between the projecting ears 58. This portion 72 is provided with a shoulder portion 74 which is shaped to mate with a matching shoulder portion 76 on the extended portion 60 of the earphone frame 55. The two mating surfaces develop frictional engagement to hold the earphone and frame at whatever angle is selected by the user. The portions 74, 76 serve as a position stop to define the limit of the angle at which the earphone 54 may be opened, relative to the earpiece 52. Thus, the user may very easily move the earphone 54 between a position flat against the ear, indicated by the numeral 68 in FIG. 4B, and the angled position, indicated by the numeral 69 in FIG. 4B.

Figure 5B:
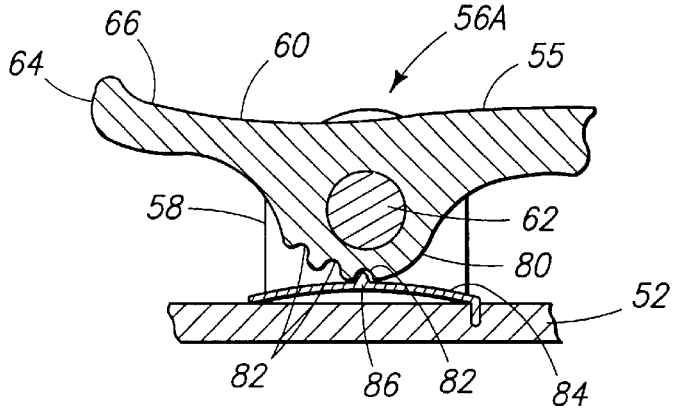

An alternative mounting arrangement also providing for variability in the angle at which the earphone is positioned for listening by the user is illustrated in FIG. 5B. This mounting arrangement incorporates a fluted cam with a spring keeper to establish a plurality of preset angles for the earphone. In this figure, the lower curved surface 80 of the pivotable mounting 56A is shown provided with a series of recesses 82, and a spring 84 having at least one detent member 86 is affixed to the earpiece 52. With this arrangement, the user may readily pivot the earphone unit to prescribed angular positions relative to the ear mounting member 52 by simply rotating the earphone with frame 55 until the detent 86 seats in one or another of the recesses 82.

Figure 6A:
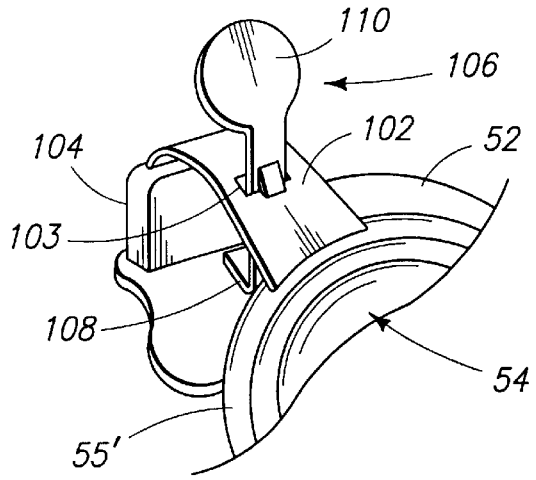
FIG. 6A is a schematic perspective view showing another particular mounting arrangement for an earphone of the present invention.
Figure 6B:
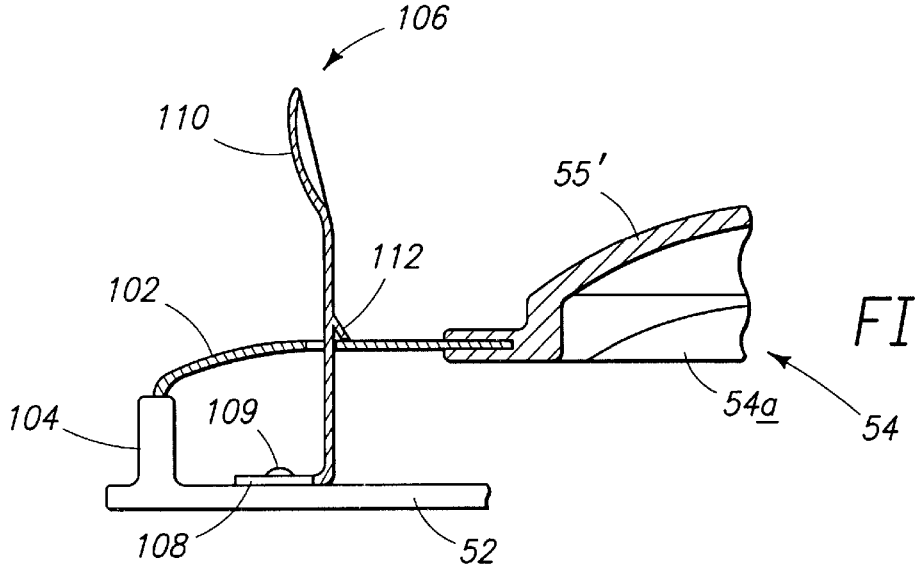
FIGS. 6B and 6C are partial sectional views of the arrangement of FIG. 6A, showing the earphone in respective conventional flat-against-the-ear and angled operational positions.
Figure 6C:
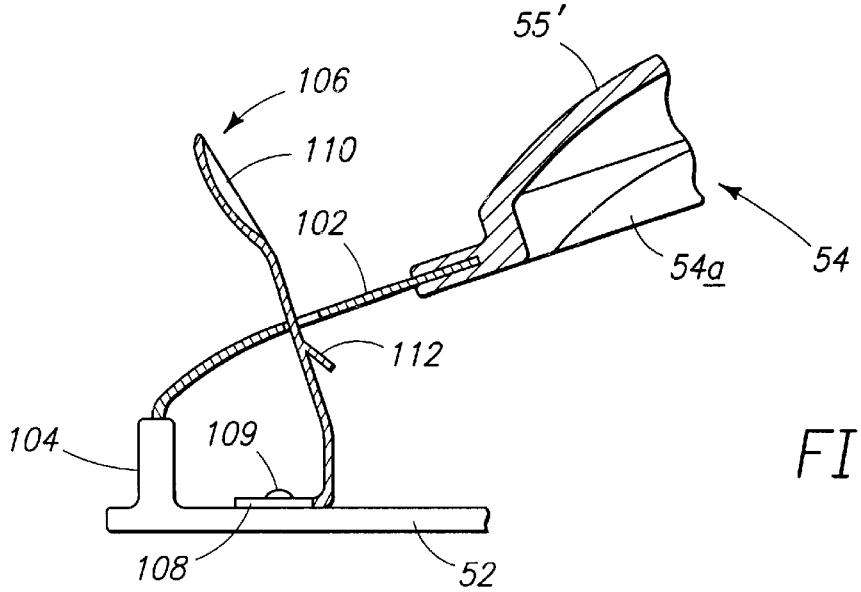

FIGS. 6A, 6B and 6C illustrate yet another detent structure for quickly positioning an earphone 54 between a flat-against-the-ear position, as in FIGS. 6A and 6B, and an open position, as shown in FIG. 6C. The earphone frame 55' is supported on a generally flat spring 102 which itself is supportably mounted in a mounting base 104 attached to the earpiece 52.

This arrangement further includes an angle adjustment lever 106. The lever 106 is a spring member attached to the earpiece 52 at one end 108 by a rivet 109 or other similar attachment means and providing at the other end a curved finger grip 110. The spring 102 has a central aperture 103 through which the angle adjustment lever 106 extends. At the point adjacent the aperture 103, the lever 106 is provided with a projecting locking ramp 112. When the earphone 54 is positioned generally parallel to the earpiece 52 as illustrated in FIGS. 6A and 6B, the locking ramp 112 engages the spring 102, locking the two pieces in the stored position. To move the earpiece 54 to the operative position shown in FIG. 6C, a slight force on the finger grip portion 110 of the lever 106 serves to release the spring 102 from the locking ramp 112 so that the spring 102 and the earphone 54, speaker 54*a* and frame assembly assume the position shown in FIG. 6C. If the earphone 54 is again moved to the position in FIG. 6B, the locking ramp 112 becomes positioned above the spring 102 such that it again serves to retain the spring in the flat-against-the-ear position.

Figure 7A:
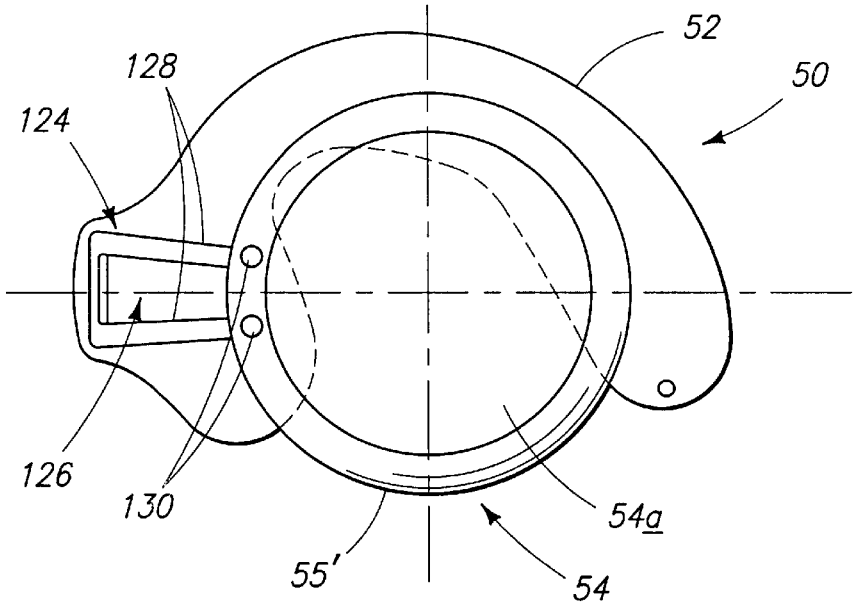
FIGS. 7A, 7B and 7C are respective left side elevational and top views of another particular arrangement in accordance with the invention showing a particular toggle spring mount.
Figure 7B:
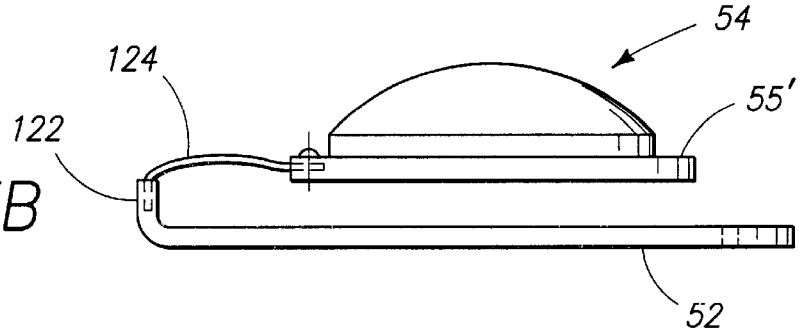
Figure 7C:
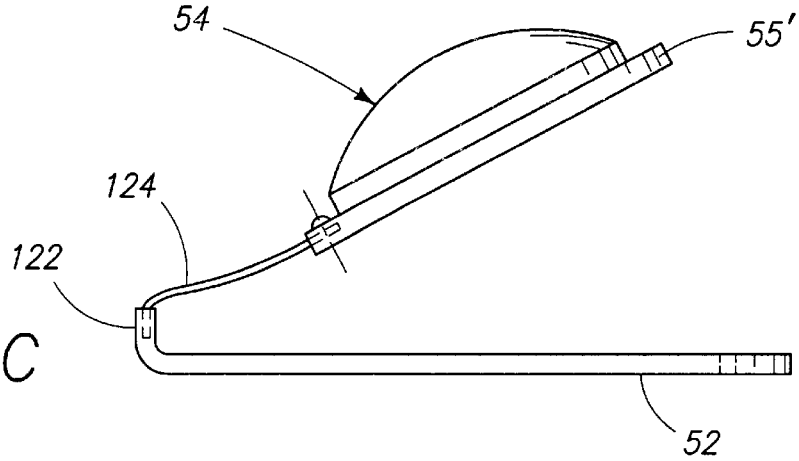

FIGS. 7A, 7B and 7C illustrate still another mounting position for an earphone assembly 50 including an earpiece or ear mount 52, an earphone 54 with speaker 54*a* and an earphone frame 55'. As best shown in FIGS. 7B and 7C, the earpiece 52 is generally L-shaped with a right angled portion 122 at one end. A spring member 124 is attached to the support portion 122 as shown. This spring 124 is configured and attached to the frame 55' in a way which establishes a toggle mounting structure. The spring 124 is constructed of spring material cut in a generally U-shaped configuration 126 (see FIG. 7A). The two sides 128 of the U-shaped spring 124 are attached to the frame 55' by fasteners 130, such as rivets or screws, which distort the spring 124 into a stressed configuration. As seen in FIG. 7A, the outer ends of the side pieces 128 are forced closer together than at the base. This causes the spring 124 to exhibit a toggle effect in positioning the earphone assembly 54 relative to the earpiece 52. Thus, when the earphone 54 is in the conventional flat-against-the-ear setting shown in FIG. 7B, the spring 124 is in an outwardly curved or convex configuration. Moving the earphone 54 away from the earpiece 52 causes the spring 124 to snap into a concave curvature, as shown in FIG. 7C. Thus, the earphone 54 may readily be moved between the positions of FIGS. 7B and 7C with very little applied force so that the earphone assumes the position desired by the user.

Figure 8A:
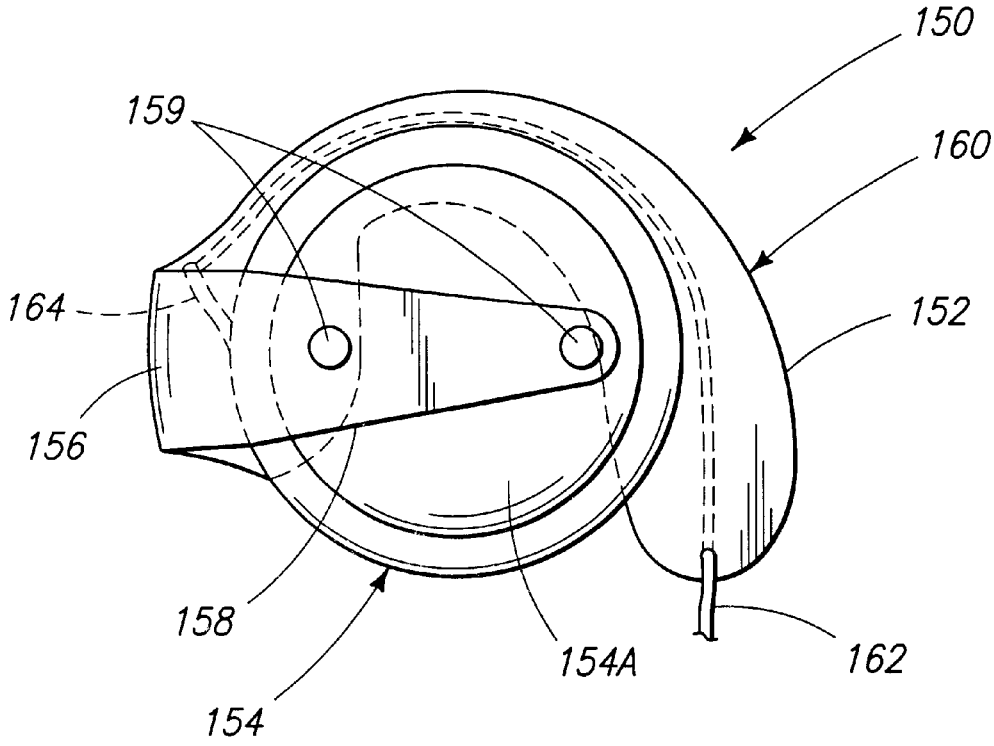
FIGS. 8A and 8B are, respectively, side elevational and top views of a left-side mounting arrangement for an earphone in still another embodiment of the present invention.
Figure 8B:
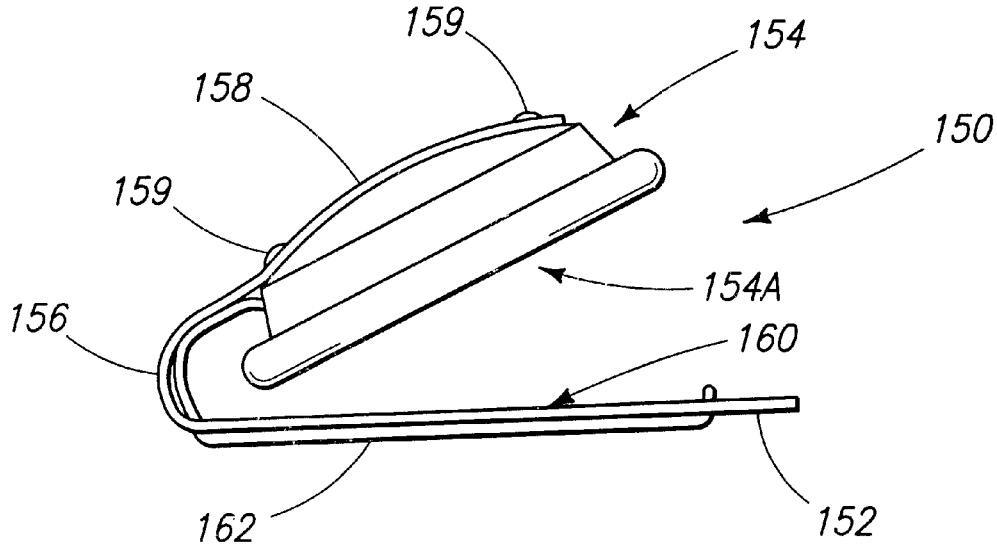

FIGS. 8A and 8B are schematic representations, side and top views, of still another version of the earphone mounting arrangement of the present invention. This version is similar to the others described hereinabove in stereophonic performance and result except that it is less costly to manufacture because of its simple construction. As with the other representations, particularly that depicted in FIGS. 4A and 4B, the unit of FIGS. 8A and 8B can be worn on either the left ear, in which case the earphone is aimed at the auditory canal from slightly forward of the ear, or the right ear, where the earphone would be angled from slightly behind the ear.

FIGS. 8A and 8B show a unitary earpiece and earphone mounting assembly 150 comprising an integral mounting and support member 160 to which is affixed an earphone 154 incorporating a speaker 154A. The member 160 comprises a shaped earpiece portion 152 fashioned for placement over the ear, a portion 156 curved in a general U-shape to establish the desired angle of the earphone and speaker, and a mounting portion 158 to which the earphone is attached by fasteners 159. It has been found that the best sound effects are achieved with an angle of about 27°, preferably within the range of 25° to 30°, although angles outside this range develop an enhanced stereophonic sound but perhaps less pronounced. These fasteners may be screws, rivets, fused plastic plugs, or any other suitable fastening elements. A wire 162 is shown extending from the lower end of the earpiece 152 (right hand side of FIG. 8A) in phantom outline to the point 164 where it enters the earphone. The support member 160 is formed of a malleable material, preferably soft aluminum, so that there is some adjustability of the angle of the earphone by simply bending the portion 156. However, the material is sufficiently stiff that it will readily maintain whatever position is established to support the earphone 154 at the selected angle relative to the auditory canal when the assembly is in place on the listener's ear.

Thus the various embodiments shown and described herein provide stereophonic earphones arranged for special mounting with respect to a listener's ears such that the sound from the earphone speakers reaches the listener with enhanced stereophonic richness, expanded sound stage, and with heightened image realism. The undesirable effects encountered by some listeners from the use of flat-against-the-ear speakers are avoided. This improvement in overall result is achieved without significant added expense.

Although there have been described hereinabove various specific arrangements of STEREO HEADSET WITH ANGLED SPEAKERS in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. An earphone for use on one side of a listener's head in conjunction with a corresponding earphone on the opposite side of the listener's head to provide stereophonic sound to the listener's ears, said earphone comprising:

a speaker and a frame supporting said speaker; and a mounting assembly including a mounting piece coupled to said frame for locating said speaker in a position spaced away from the external auditory canal of the listener's ear and at a selected angle of incidence relative thereto such that sound waves from said speaker diffract into the listener's auditory canal;

said mounting assembly including a toggle spring extending between said mounting piece and said speaker frame for supporting said speaker and frame therefrom, said toggle spring having an over-center configuration such that when the speaker frame is moved past the over-center position, said speaker and frame are held in one of two toggle positions;

wherein said toggle spring comprises metal spring material cut in a generally U-shaped configuration having two side pieces joined to a base, the ends of the side pieces which are remote from the base being fastened to the speaker frame in said over-center configuration;

whereby the sound stage afforded by a stereophonic pair of said earphones is expanded beyond that of a pair of stereophonic earphones mounted flat against a listener's ears.

2. The earphone of claim 1 further including, in combination therewith, a second earphone constructed as a mirror image of said first-mentioned earphone, and electrical wiring connected to said earphones for transmitting electrical sound signals to said earphones to provide stereophonic sound to the listener's ears.

3. The earphone of claim 1 wherein said ends of the side pieces are mounted closer together than the spacing at the base to establish said toggle positions.

4. An earphone for use on one side of a listener's head in conjunction with a corresponding earphone on the opposite side of the listener's head to provide stereophonic sound to the listener's ears, said earphone comprising:

a speaker and a frame supporting said speaker;

a mounting assembly coupled to said frame for locating said speaker in a position spaced away from the external auditory canal of the listener's ear and at a selected angle of incidence relative thereto such that sound waves from said speaker diffract into the listener's auditory canal;

wherein said mounting assembly comprises an integral support member having a first portion shaped for positioning over a listener's ear between the listener's head and the pinna of the ear, a second portion affixed to the earphone frame to support the speaker at a selected angle, and a continuous curved reentrant portion integrally formed with the first and second portions; and further including:

a second earphone constructed as a mirror image of said first-mentioned earphone; and electrical wiring connected to said earphones for transmitting electrical sound signals to said earphones to provide stereophonic sound to the listener's ears; wherein said electrical wiring comprises an electrical lead for each earphone, which lead is positioned along the first portion of the integral support member for said earphone and extends from a point adjacent the curved reentrant portion along said first portion to a point at the end remote from said reentrant portion where it leaves said first portion to connect to a source of said electrical sound signals;

whereby the sound stage afforded by a stereophonic pair of said earphones is expanded beyond that of a pair of stereophonic earphones mounted flat against a listener's ears.

5. The earphone of claim 4 wherein said electrical lead is directed downwardly from said first portion when the earphone is mounted in position on a listener's ear.

* * * * *